United States Patent [19]

Beinke et al.

[11] 4,382,802

[45] May 10, 1983

[54] FIRE STARTERS

[75] Inventors: Hans C. Beinke, Manchester, Mo.; Robert C. Cuca, Edwardsville, Ill.

[73] Assignee: K-V Pharmaceutical Company, St. Louis, Mo.

[21] Appl. No.: 269,527

[22] Filed: Jun. 2, 1981

[51] Int. Cl.[3] ..... C10L 1/32

[52] U.S. Cl. ..... 44/51; 44/6; 252/312

[58] Field of Search ..... 44/51, 6; 252/312, DIG. 1

[56] References Cited

U.S. PATENT DOCUMENTS

| | | | |
|---|---|---|---|
| 1,960,917 | 5/1934 | Nagelvoort | 44/6 |
| 3,489,690 | 1/1970 | Lachampt et al. | 252/312 |

*Primary Examiner*—Charles F. Warren
*Assistant Examiner*—Y. Harris-Smith
*Attorney, Agent, or Firm*—Neal Kalishman

[57] ABSTRACT

A first starter which is an oil-in-water emulsion whose internal phase is 70% of the emulsion. The emulsion has superior ignitability characteristics due to the use of an emulsifier which is a $C_{12}$–$C_{20}$ commercial blend of fatty alcohols that have been ethoxylated and propoxylated.

7 Claims, No Drawings

FIRE STARTERS

BACKGROUND OF THE INVENTION

I. Field of the Invention

The present invention is directed to fire starters. Specifically the invention is directed to fire starters that are in the form of oil-in-water emulsions.

II. Description of the Prior Art

A common problem experienced by consumers is the starting of fires. Such fires include charcoal fires for cooking and wood fires for enjoyment. Normally, petroleum distillates are utilized as an aid in starting such fires since applying a lit match directly to the charcoal or wood is ineffective.

The petroleum distillates of the prior art are characterized by burning relatively rapidly and flowing away from their intended point of use due to their low viscosity. These products also pose safety problems due to their tendency of "flash back" and contain 94–100% burnable liquids. The commonly available solid fire starters have proved ineffective since they do not stay in place and are often difficult to ignite.

There have been proposals for formulating a jet fuel in the form of an oil-in-water emulsion. These emulsions contain at least 75% internal or oil phase. These emulsions have not been suitable as fire starters since they are difficult to ignite.

The present invention is advantageous since it provides a fire starter which can be ignited by conventional means, resists flach back, is easy to use, propogates well, has a long-burning flame and requires a smaller amount of burnable liquid.

SUMMARY OF THE INVENTION

An oil-in-water emulsion fire starter, the improvement which comprises using an emulsifier, which is an ethoxylated and propoxylated $C_{12}$–$C_{20}$ commercial blend of fatty alcohols.

DESCRIPTION OF THE PREFERRED EMBODIMENTS

The present invention is directed to fire starters which are burnable emulsions and which can be ignited by conventional means. This contrasts current burnable emulsions, usually high internal phase ratio, which are often difficult to ignite by conventional means.

The emulsions of the invention are comprised of lipoidal and nonlipoidal phases. The lipoidal phase comprises at least 70 percent by volume of the emulsion and is the internal phase. The term lipoidal pertains to any of a group of organic compounds comprising fats, fatty acids, waxes, petrolatum, fatty acid esters, mineral oils, petroleum distillates and vegetable oils. The compounds have the common properties of being insoluble in water and soluble in alcohol, ether, chloroform or other fat solvents. The lipoidal phase may also contain colors, fragrances and/or stabilizers. These emulsions are classified as high internal phase ratio emulsions and therefore have an internal phase greater than 70 percent. The percentage of the internal phase usually ranges between 90 percent and 96 percent. The volitile, readily burnable portion of the internal phase is 95 percent to 100 percent of the phase and is usually 98 percent to 100 percent of the internal phase.

The external phase is comprised of nonlipoidal media. This phase is the continuous phase of the emulsions. This phase may comprise either water, glycerine, sorbitol, sugar syrups, ethylene glycol or any combination thereof. The external phase contains 70 percent to 95 percent water by volume and is usually 75 percent to 85 percent water. The external phase may also contain colors, fragrances, anti-freezes, stabilizers or combinations thereof.

The emulsifiers are the product of ethoxylating and propoxylating commercial blends of fatty alcohols. The fatty alcohol blends may be composed of any number of possible $C_{12}$–$C_{20}$ fatty alcohols but are preferably a blend of $C_{12}$–$C_{14}$ fatty alcohols. In ethoxylating and propoxylating the fatty alcohols, the ethylene oxide and propylene oxide may be added either block or random and their mole ratio must be 2 1/2:1 to 3 1/2:1, preferably 3:1. The combination of the ethoxylation and propoxylation should be such that the hydrophilic-lipophilic balance (HLB) is eight or greater. The emulsifiers of this invention differ from those of the prior art since they are made using fatty alcohols of a longer chain length and have an ethylene oxide/propylene oxide mole ratio of between 2 1/2:1 and 3 1/2:1.

It appears that the use of emulsifiers whose fatty alcohol chain is in the $C_{12}$–$C_{20}$ range and whose ethoxylation/propoxylation ratio is approximately 3:1 provides desirable characteristics in the fire starter. It allows it to be readily ignited by conventional means, i.e. matches. Since the emulsion contains only the lipoidal and non-lipoidal media it can be economically and simply produced while achieving a highly effective product.

The fire starters may be prepared by continuous or batch processes. As in preparing conventional emulsions, shear force is applied to the system components by use of a homogenizer, mill, mixer, agitator, impingement surfaces, ultra-sound, shaking or vibration. Unlike conventional emulsions, the mixing shear should be at low levels in order to prevent destruction of the system by imparting excess energy. Temperature is not usually a critical factor in the preparation of the systems. The temperatures utilized will be dependent upon the final end product desired.

The fire starter may be prepared by mixing the internal with the external phase in a planetary-type mixer. Another manner of preparing the system is by use of a continuous mixer which comprises multiple impellers. The external phase is first introduced into the continuous mixer until it reaches the level of the lowest impeller in the mixing chamber. The two phases are then simultaneously introduced through the bottom of the mixer in proper proportion as its impeller or impellers rotate to apply a shear to the components. The finished product emerges through the top of the mixer. The actual speed of the impeller or impellers will vary depending upon the product produced as will the rate of flow of the two phase streams.

The following examples are illustrative of the invention.

Method of Preparation: Ingredients of the internal phase were mixed together at room temperature. The ingredients of the external phase were mixed together in a one-gallon vessel. The internal phase composition was slowly added to the external phase composition as the two phases were mixed together with a split disc stirrer at low shear until the desired viscosity was obtained.

The same product was also prepared by introducing the internal and external phases continuously into the bottom of a mixer following the formation of a preformed emulsion. The finished product emerged through the top of the mixer at one liter/minute.

| FIRE STARTER<br>Viscosity = 35,000 cps | |
|---|---|
| Ingredients | % wt./wt. |
| Internal Phase | |
| Kerosene | 92.673 |
| External Phase | |
| Ethylene Glycol | 0.8 |
| Emulsifier ($C_{12}$–$C_{14}$ fatty alcohol blend reacted with 3 moles of ethylene oxide and 1 mole of propylene oxide) | 0.73 |
| $H_2O$ | 5.79 |

The invention may be embodied in other specific forms without departing from the spirit of essential characteristics thereof. The present embodiments are therefore to be considered in all respects as illustrative and not restrictive, the scope of the invention being indicated by the appended claims rather than by the foregoing description, and all charges which come within the meaning and range of equivalency of the claims are therefore intended to be embraced therein.

We claim:

1. An emulsion that acts as a fire starter which has a lipoidal internal phase comprising at least 70% of the emulsion and a nonlipoidal external phase the improvement which comprises emulsifing said internal and external phases with an emulsifier which is an ethoxylated and propoxylated $C_{12}$–$C_{20}$ blend of fatty alcohols wherein the mole ratio of ethylene oxide to propylene oxide is between 2-1/2:1 and 3-1/2:1.

2. The fire starter of claim 1 wherein said emulsion is an oil-in-water emulsion.

3. The fire starter of claim 1 wherein said emulsifier is a block polymer.

4. The fire starter of claim 1 wherein said emulsifier is a random polymer.

5. The fire starter of claim 1 wherein said emulsifier has a hydrophilic-lipophilic balance of at least 8.

6. The fire starter of claim 1 wherein said alcohol is a $C_{12}$–$C_{14}$ commercial blend of fatty alcohols.

7. The fire starter of claim 1 wherein the mole ratio of ethylene oxide and propylene oxide is 3:1.

* * * * *